US008827338B2

(12) United States Patent
Biggert

(10) Patent No.: US 8,827,338 B2
(45) Date of Patent: Sep. 9, 2014

(54) CLAMP AND HOISTING DEVICE

(75) Inventor: Charles Anthony Biggert, Tomball, TX (US)

(73) Assignee: NuDawn Metal Fabrication, Inc., Spring, TX (US)

( * ) Notice: Subject to any disclaimer, the term of this patent is extended or adjusted under 35 U.S.C. 154(b) by 118 days.

(21) Appl. No.: 13/599,478

(22) Filed: Aug. 30, 2012

(65) Prior Publication Data

US 2014/0062111 A1 Mar. 6, 2014

(51) Int. Cl.
*B66C 1/42* (2006.01)

(52) U.S. Cl.
USPC ..... 294/119.2; 294/31.2

(58) Field of Classification Search
CPC ..... E21B 19/06; E21B 19/07; E21B 19/10; E21B 19/00; A47J 45/10; A47J 45/077; A45F 5/10; B65G 59/062; B65G 17/063; B65G 17/24; B65G 2201/02; B65G 60/00; B25B 27/10; B25B 27/0028; B25B 27/00; B25B 27/28; B25B 5/12; B25B 5/068; B25B 5/163; B25B 5/06; B25B 5/122; B29C 65/00
USPC ..... 294/27.1, 31.2, 119.2, 165, 90, 102.2; 166/77.52, 85.1; 29/235–239, 255, 29/270; 269/228, 3, 6; 24/280, 285, 335
See application file for complete search history.

(56) References Cited

U.S. PATENT DOCUMENTS

| | | | | | |
|---|---|---|---|---|---|
| 2,264,775 | A | * | 12/1941 | Spang | 294/90 |
| 2,301,625 | A | * | 11/1942 | Johnson | 175/423 |
| 2,938,484 | A | * | 5/1960 | Garland | 114/20.1 |
| 3,414,950 | A | * | 12/1968 | Phariss | 24/280 |
| 3,944,202 | A | * | 3/1976 | Dearman | 269/130 |
| 4,336,637 | A | * | 6/1982 | Patterson | 188/67 |
| 4,726,575 | A | * | 2/1988 | Dearman | 269/43 |
| 6,361,251 | B1 | | 3/2002 | Soltanahmadi et al. | |
| 6,962,205 | B1 | * | 11/2005 | Lay, Jr. | 166/368 |

FOREIGN PATENT DOCUMENTS

| | | |
|---|---|---|
| EP | 0993541 | 3/2003 |

* cited by examiner

*Primary Examiner* — Stephen Vu
(74) *Attorney, Agent, or Firm* — John J. Love; Claude Cooke, Jr.; Cooke Law Firm

(57) ABSTRACT

A clamp and hoisting device serves the dual purpose of preventing a sleeve over a tubular or column like structure from sliding in an axial direction and also provides a connection point for a hoisting device. The device includes first and second arms composed of a plurality of arcuate links. Each arm is connected to an upper connector block and a lower connector block. The two arms are positioned over the tubular and the two lower connector blocks are secured to each other thereby forming a clamp. The upper connector block includes a connection point for attachment to a hoisting mechanism so that the clamp also serves as an attachment point for a hoisting mechanism.

14 Claims, 7 Drawing Sheets

CLAMP AND HOISTING DEVICE

BACKGROUND OF INVENTION

1. Field of the Invention

This invention is directed to a device that can be used as a clamp to prevent items such as a buoyancy sleeve on a marine well rise pipe from sliding along the pipe and also can be used to lift the item by attachment to a suitable hoisting device. The device can be used as a clamp in any situation where it is desired to prevent axial movement of an outer member with respect to an inner member.

2. Description of Related Art

Marine well riser pipes typically are provided with a buoyancy sleeve that surrounds the riser pipe and is prevented from axial displacement by a pair of collars positioned on the pipe at the opposite ends of the sleeve. Current clamps as shown in FIGS. 1 and 2 of the drawings are composed of a plurality of arcuate portions having interior walls that engage the outer surface of the riser pipe. The sections are rigidly connected to each other by nuts and bolts passing through apertures formed in flanges that extend outwardly of the arcuate bodies.

The clamps are typically located near the connection point where two risers are connected together. A plurality of conduits extend along the riser pipe assembly and surround the clamp as shown in FIG. 3 making it difficult to access the clamps. In order to lift the riser pipe, a strap 14 is required as shown in FIG. 3.

BRIEF SUMMARY OF THE INVENTION

The invention of this patent application is a clamp and hoisting device that prevents a sleeve from axially moving on a tubular or any object having a cylindrical profile, such as a marine wall riser pipe, a bridge concrete column, or a light pole, or any elongated pipe or tubular member. It is made of multiple curved links that have an internal diameter and outside diameter radius that wrap around the item being clamped. Bolts are then used to tighten the two ends to give it its holding pressure. Because it is made of multiple links, it creates multiple holding pressure points that help prevent the clamp from sliding from its fixed position on the tubular member. The clamp is also provided with a lift point on it or a swing block for mounting, lifting and other accessories that might need to be held in a fixed position at the location of the clamp. It is a multi-link with pin joints that gives the clamp mounting capability to flex in and around tight areas for installation. In the offshore drilling and production industry, there is a need to lift heavy items like drilling risers, mocomp parts, drop lines and other round items. Now, a fork lift or crane with straps or spreader bars is used that sometimes damages the flotation on the riser itself. Also, on a riser to stop the buoyancy sleeve from shifting on the riser a stop collar is used, which is made from a strap and bolt design. The clamp of the present invention used as a single component will do two things at the same time. With a lift eye on the link clamp, it can be used as a lifting device and as well as a clamp to stop the buoyancy sleeve from shifting on riser. When used to help lift heavy items like concrete round columns used on bridges it will replace the need for cable and straps wrapped around the column. With the ability to have two sided lifting, the column can be put in a hole straight up and down without having to push or pull the bottom of the column around the hole it is being placed in. In other areas where straps or ring clamps are used where failure can result from rust, galvanic, electrolysis or abrasion to the item, the link clamp can be made from non-corrosive materials for saltwater applications or in heavy corrosive environments. It can also be coated with rubber or other coatings to help ensure the clamp and component it is clamped to receive the ultimate protection from harsh environments.

BRIEF DESCRIPTION OF THE SEVERAL VIEWS OF THE DRAWING(S)

DETAILED DESCRIPTION OF THE INVENTION

Figure 1:
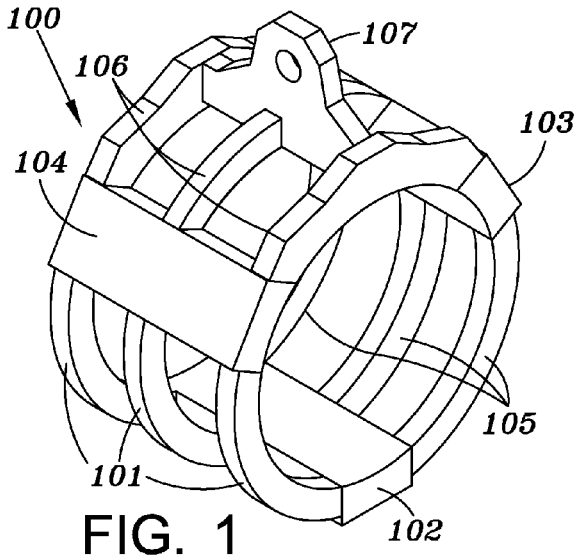
FIG. 1 PRIOR ART
FIG. 1 is a perspective view of a prior art clamp.

FIG. 1 illustrates a first prior art clamp 100. It includes a plurality of first lower ring members 101, second lower ring members 105, and third ring members 106. They are rigidly connected together by three solid blocks 102, 103, and 104. An attachment member 107 is fixed to the clamp and serves as an attachment member for a suitable hoisting device.

Figure 2:
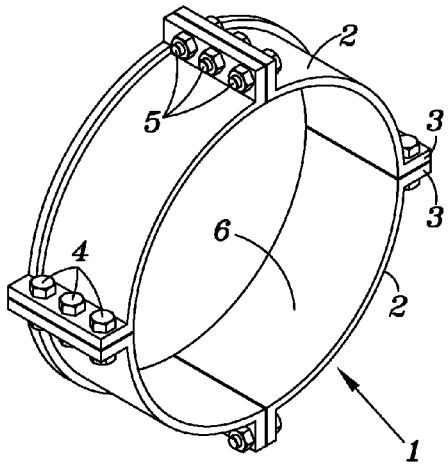
FIG. 2 PRIOR ART
FIG. 2 is a perspective view of a second prior art clamp.

As described above, a second prior art clamp is shown in FIGS. 2 and 3. It includes a plurality of arcuate members 2 that include an inner surface 6 adapted to contact the outer surface of a tubular. The arcuate members include flanges 3 having apertures that are adapted to receive a plurality of bolts so that the arcuate members are rigidly attached to each other to form a clamp.

Figure 3:
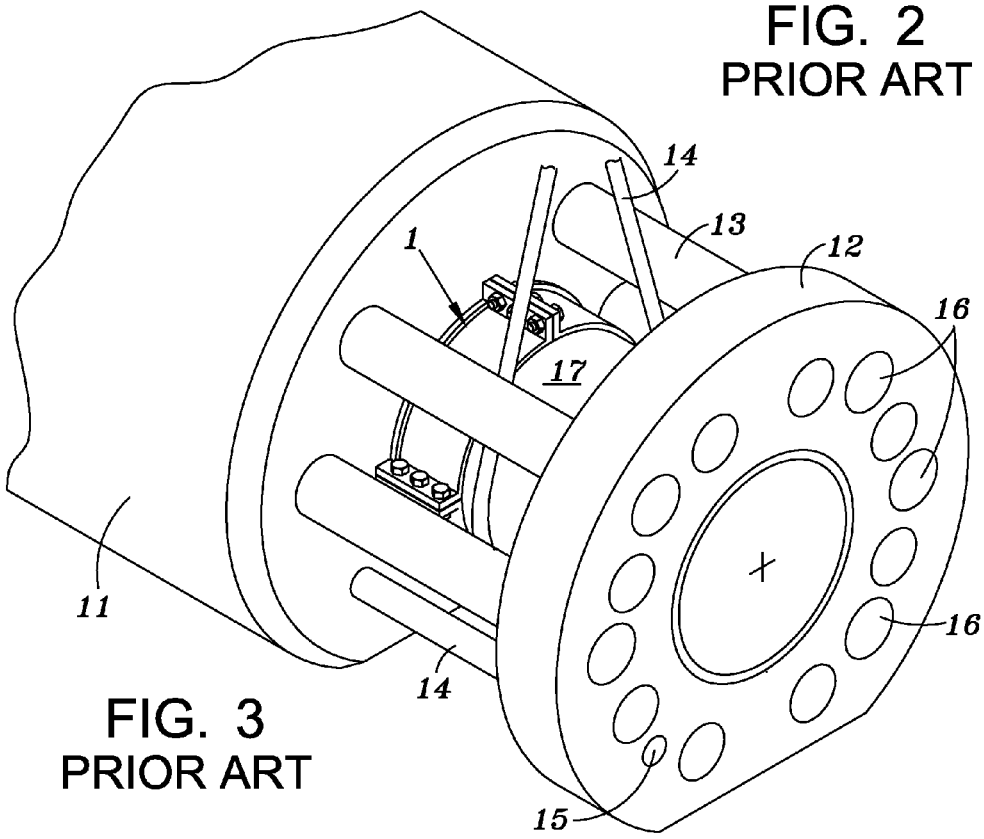
FIG. 3 PRIOR ART
FIG. 3 is a perspective view of a prior out clamp positioned on a user pipe.
Figure 5:
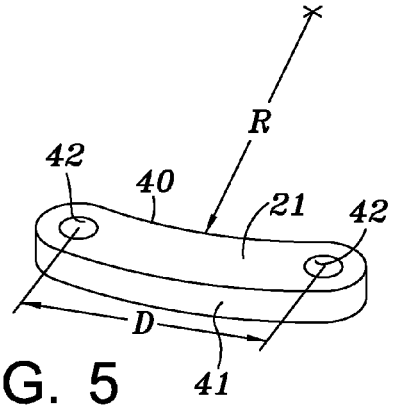
FIG. 5 is a perspective view of a link used in the embodiment of FIG. 3.

As shown in FIG. 3, the clamp 1 is secured to the tubular 17. A buoyancy sleeve 11 surrounds tubular 17 and clamp 1 prevents sleeve 11 from moving axially along the tubular. A plurality of conduits 13, 14 extend through sleeve 11 and are attached to the flange 12 of the tubular. In order to lift the tubular, a chain 14 may be positioned at each end of the tubular as shown in FIG. 3. The conduits 13 and 14 that extend around clamp 1 make it difficult to manually access the clamp.

Figure 4:
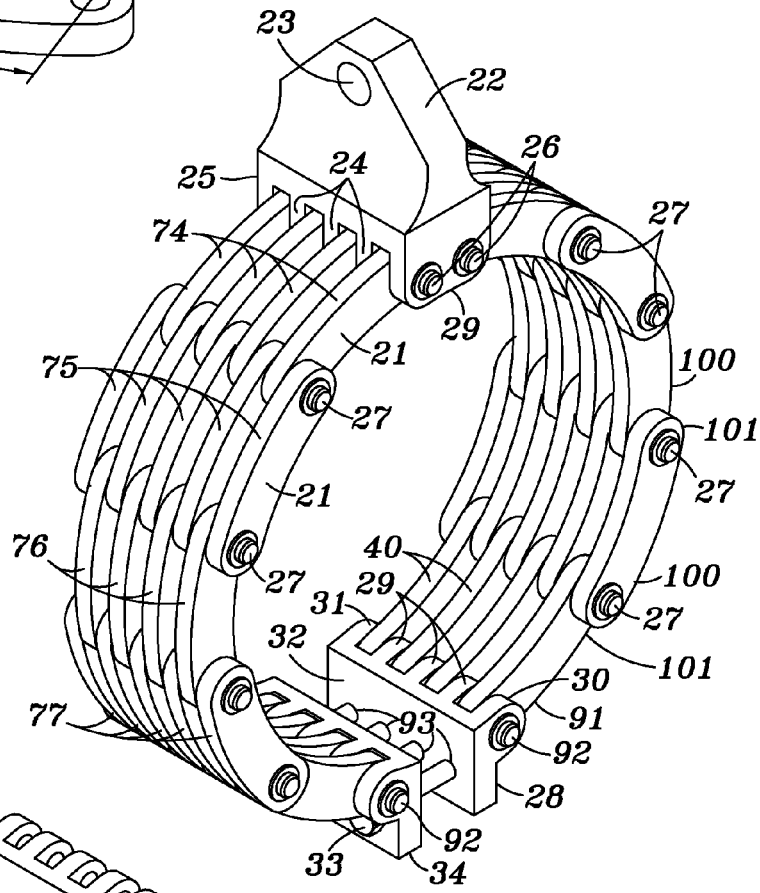
FIG. 4 is a perspective view of an embodiment of the clamp and hoisting device according to the invention.
Figure 10:
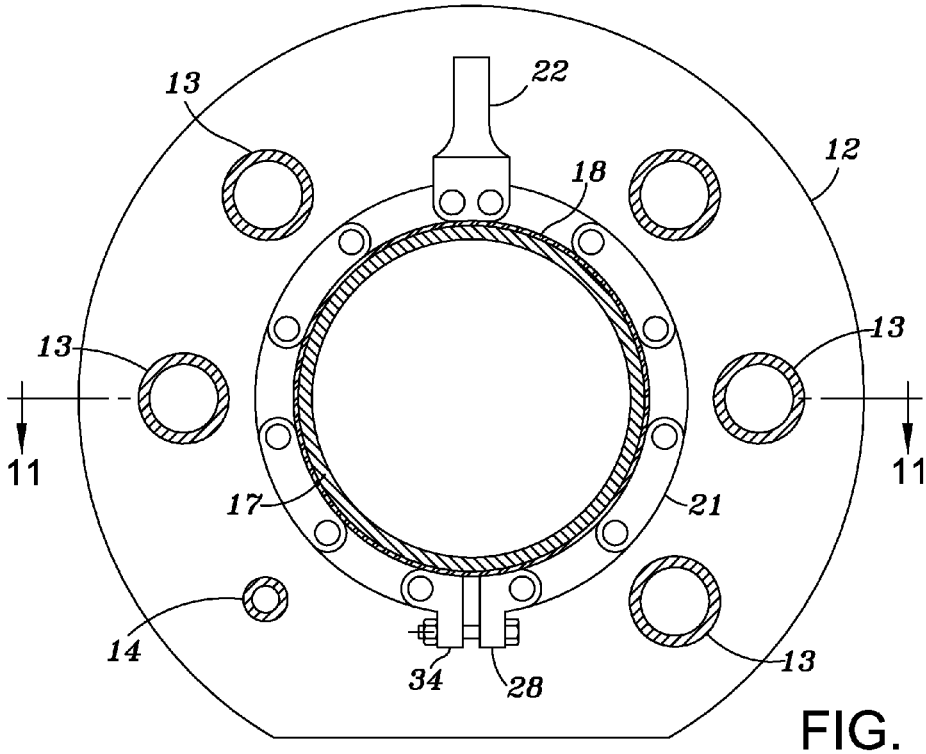
FIG. 10 is a cross-sectioned view taken along line 9-9 of FIG. 7.

A clamp 20 according to an embodiment of the invention is depicted in FIG. 4. The clamp is formed primarily from a plurality of arcuate links 21. Each link has an inner curved surface 40 that has a radius of curvature chosen such that in the assembled condition shown in FIG. 4, surfaces 40 will contact the outer surface of the tubular 17 for which it is designed. The number of links and their radius of curvature is selected so as to conform to the outer surface of the tubular 17 as shown in FIG. 10. This may take into account a protective collar 18 positioned over the tubular as shown in FIG. 10.

As shown in FIG. 4 the clamp and hoisting device includes an upper solid block connector 22 made of a strong material such as steel or aluminum. Block member 22 includes outer wall portions 25 and 29 and a plurality of spaced apart depending partitions 24 that form a plurality of slots in which an end of the links are pivotably mounted.

Figure 16:
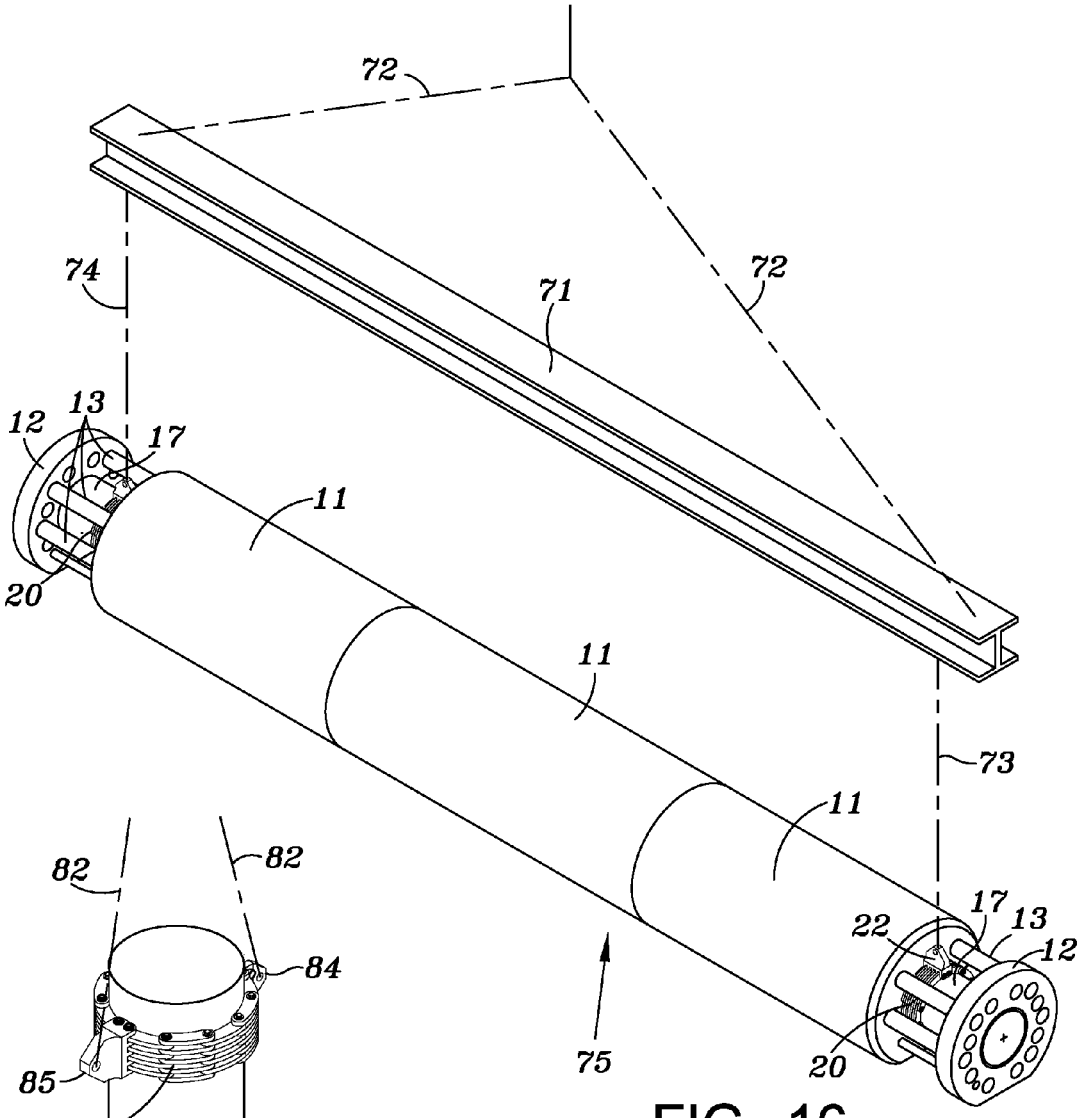
FIG. 16 is a perspective view of the clamp and hoisting device positioned on either end of a marine well user pipe connecting to a hoist.

In the embodiment of FIG. 4, the solid block connector has two sets of apertures which extend through side walls 25, 29 and partitions 24 so that a pivot pin 26 can be passed through the block and apertures 42 in the links. In this manner a first plurality of links can be attached to the solid block connector 22 on the left side of the block and a second plurality of links 21 can be pivotably attached to the right side of the block as shown in FIG. 4. The upper connector block 22 has a transverse extending bore 23 for connection to a suitable hoisting mechanism as shown in FIG. 16.

Additional pluralities of links can be rotatably secured to respective ends of the links 21 by pivot pins 27 as shown in FIG. 4 until each side of the clamp forms an approximate semi-circle. The lower ends 91 and 92 of the lower most links are pivotably connected to two lower solid block connectors 28 and 34. Lower block connectors 28 and 34 are similar in structure and include a solid block member 32 having end walls 30 and 31 and a plurality of partitions 29 which form slots to receive the lower most end of links 21. The lowermost plurality of links are pivotably connected to the respective lower connector block by a pivot pin 92 that extends through apertures 42 of the links and apertures provided in the side walls 30, 31, and partitions 29.

Lower connectors blocks 28, 34 also have a plurality of bores 93 in a lower portion thereof arranged to receive a plurality of fasteners such as bolts 33 that are used to tighten and secure the clamp around the tubular 17 as shown in FIG. 10.

Thus a first clamping arm is formed of a plurality of links pivotably connected to each other extending from the upper connector block down to the first lower connector block 34. A second clamping arm is formed of a plurality of links pivotably connected to each other extending from the upper connector block down to the second lower connector block 28. In use the first and second clamping arms can be positioned over the tubular and first and second lower connector blocks can be fastened together until the clamp is securely fixed to the tubular.

As shown in FIG. 4, each arm consists of a plurality of flights 74, 75, 76, 77 which included a plurality of axially spaced links. The links of a flight are pivotable coupled at their upper ends 101 to the lower end 100 of the links positioned above them when looking at the orientation shown in FIG. 4.

Figure 6:
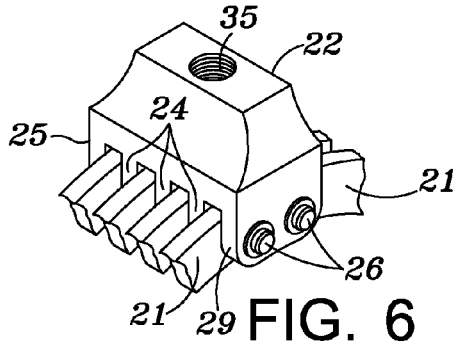
FIG. 6 is a perspective view of an embodiment of the upper connection block for the links.

FIG. 6 illustrates a variation for the upper connector block 22. In lieu of a bore 23 extending through the block, a threaded bore 35 may be formed in the upper portion of the connector block for attaching accessories such as a lift eye bolt, otherwise it is the same as the embodiment shown in FIG. 4.

Figure 7:
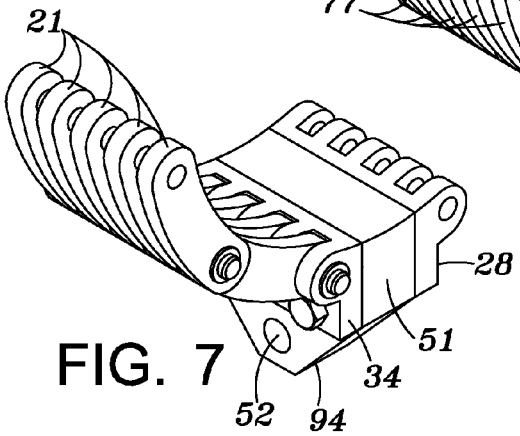
FIG. 7 is a perspective view of another embodiment of the lower connection block for the links.
Figure 17:
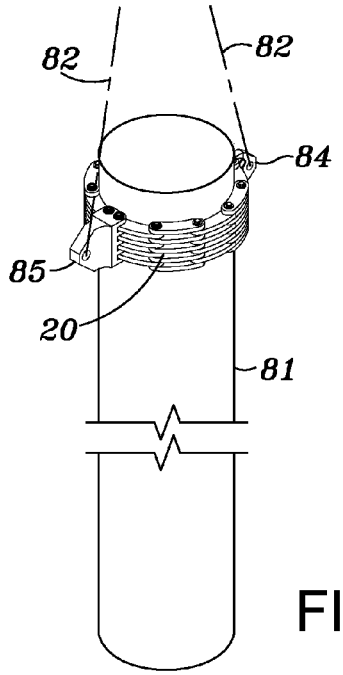
FIG. 17 is a perspective view of the clamp and hoisting device positioned on an end of a column.

FIG. 7 illustrates a variation for the two lower block connectors 28 and 34. In this case a solid member 51 is positioned between the lower block connectors 28 and 34 and has bores aligned with the bores 93 provided in the lower block connectors 28 and 34. Solid member 51 has a downwardly extending flange 94 having a bore 52 for receiving a hoisting mechanism when the clamp is utilized for hoisting a vertical column 81 as shown in FIG. 17.

Figure 8:
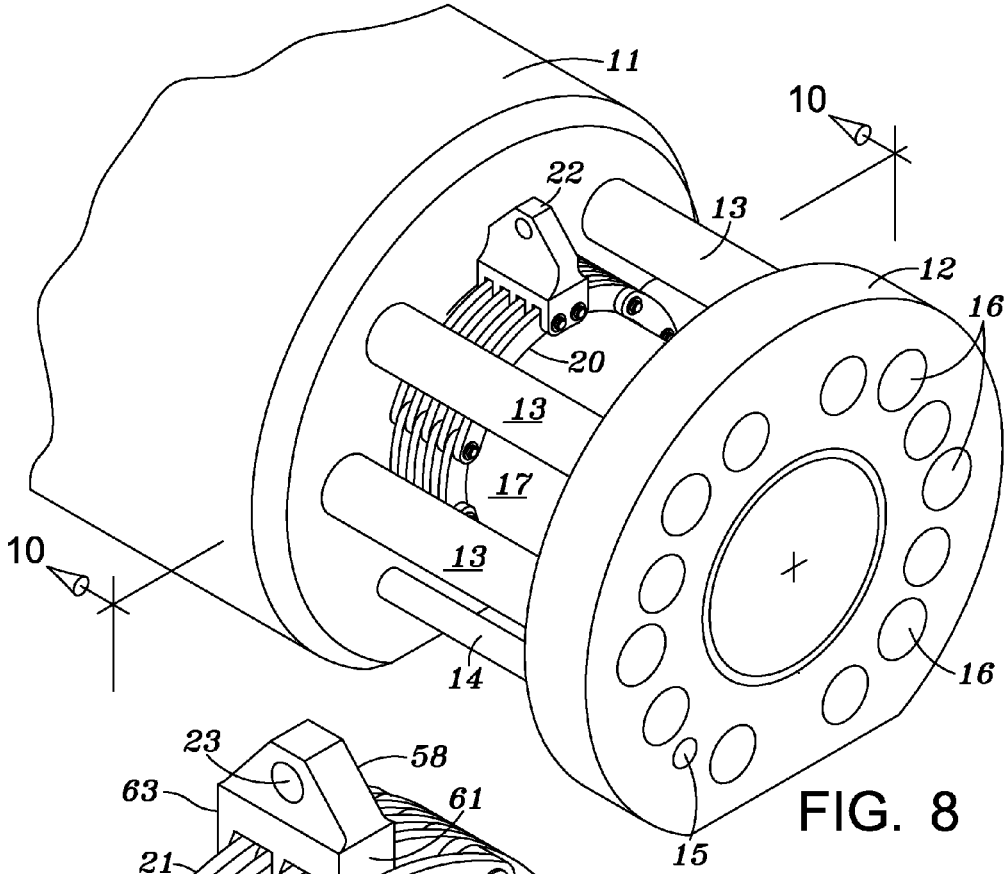
FIG. 8 is a perspective view of the invention positioned around a marine well riser pipe.
Figure 11:
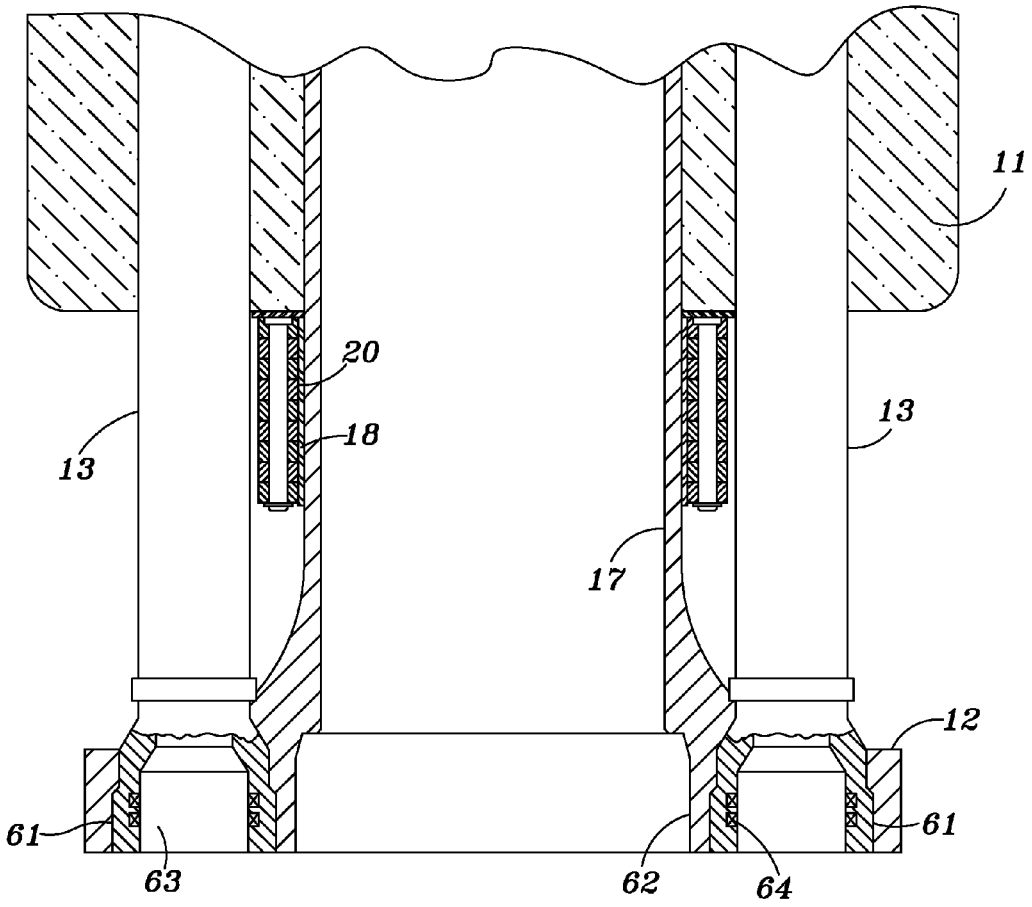
FIG. 11 is a cross-sectioned view taken along line 10-10 of FIG. 9.
Figure 12:
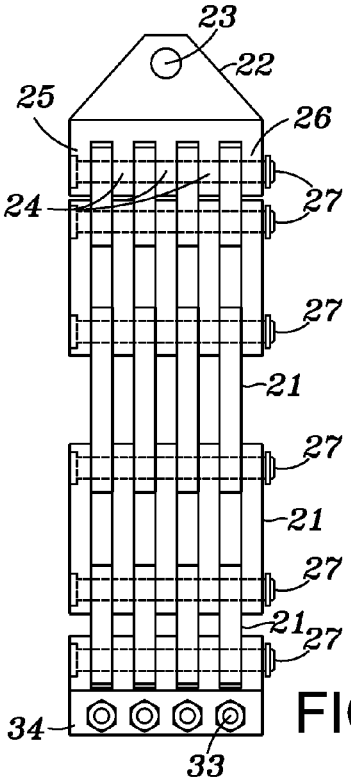
FIG. 12 is a side view of the clamp and hoisting device of FIG. 3.
Figure 13:
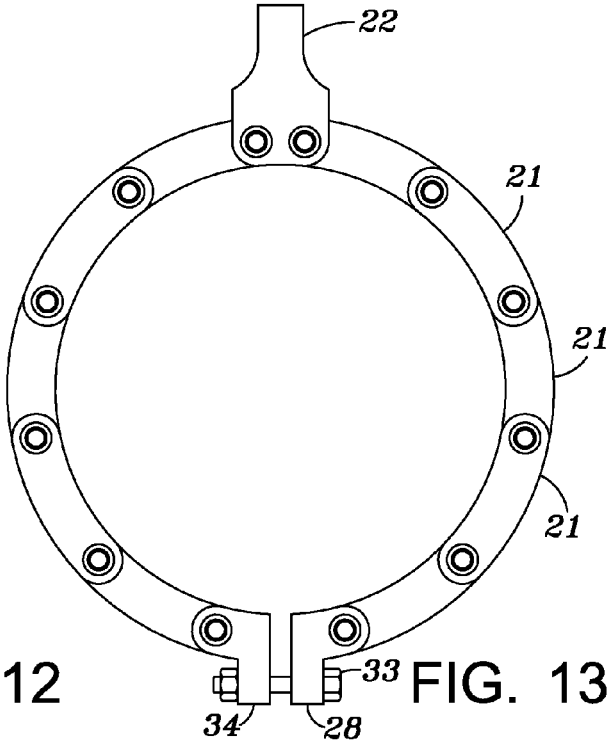
FIG. 13 is a front view of the clamp and hoisting device of FIG. 3.

FIGS. 8, 10, and 11 illustrate the manner in which the clamp and hoisting device can be used in conjunction with a marine well riser pipe. Initially lower connector blocks 28 and 34 are not connected together so that the left and right arms of the clamp can hang freely from the upper connector block 22. In this state the clamp can be lowered and maneuvered between the conduits 13 and 14 to a position surrounding the tubular riser pipe 17. Lower connector blocks 28 and 34 can then be bolted together to tightly engage the tubular 17. A protective covering 18 may be positioned between the clamp 22 and the tubular 17.

As shown in FIG. 11, flange 12 of the tubular 17 has a plurality of apertures 61 for the ends of conduits 13. The ends 63 of conduits 13 are adapted to be connected to additional conduits 13 and include seals 64.

Figure 9:
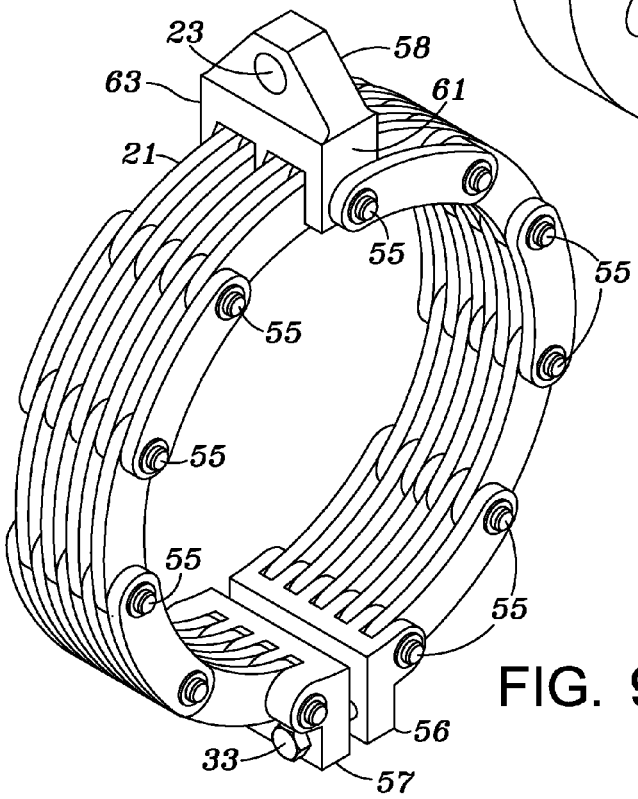
FIG. 9 is a perspective view of a second embodiment of the invention.
Figure 15:
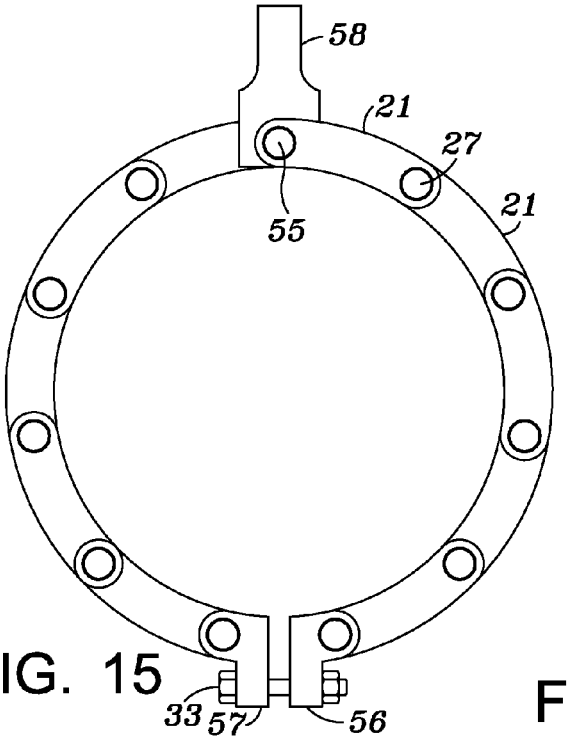
FIG. 15 is a front view of the clamp and hoisting device of FIG. 8.
Figure 14:
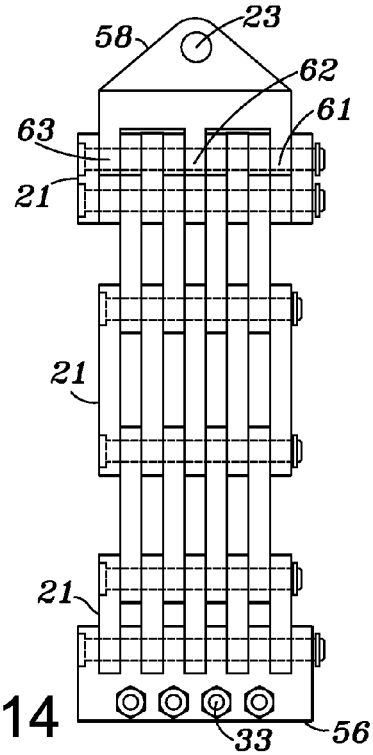
FIG. 14 is a side view of the clamp and hoisting device of FIG. 8.

FIGS. 9, 14, and 15 illustrate a second embodiment of the invention. In this embodiment, upper block connector 58 includes side walls 61, 63 and a central partition 62. A single pivot pin 55 extends through side walls 61, 63, and central partition 62. A plurality of links 21 extend alternately and outwardly on opposite sides of the upper connector block 58 as shown in FIGS. 9 and 14. The first flight of links on the left side of the clamp consists of four axially spaced links and the first flight of links on the right side consists of five links. Top pin 55 extends through the left side of the links forming the first right side flight and extends through the right side of the links forming the left side flight. Thereafter a plurality of flight of links are connected to the respective previous flight of links by pivot pins 55. The last flight of links are pivotably connected to the lower connector blocks 56 and 57 in a manner similar to that described with respect to the embodiment of FIG. 4. With the clamp positioned over the tubular, lower connector blocks 56, 57 are secured together by bolts 33 so that the clamp is tightly secured to the tubular 17.

FIG. 16 illustrates the manner in which the clamp and hoisting device can be utilized in conjunction with a hoisting mechanism for a marine well riser pipe. A hoisting beam 71 is attached to a hoisting mechanism via flexible chains 72 or the like. Marine well riser pipe 75 may include a plurality of buoyancy sleeves 11 around a tubular 17 which includes end flanges 12. A plurality of conduits 13 are positioned within the sleeves 11 and extend to flanges 12. A clamp and hoisting device can be positioned about each end of the tubular with the sleeves 11 located between them. The clamp and hoisting device will thus prevent axial movement of the sleeves along the tubular 17. Chains 74 and 73 extend downwardly from the hoist beam 71 and may be attached to the upper connector block 22 or 58 at 23.

FIG. 17 illustrates the manner in which the clamp and hoisting device can be utilized to raise and lower column like structures. The clamp and hoisting device as shown in FIG. 7 can be positioned around the top of a column structure 81 and chains or the like 82 can be attached to the upper connector block 85 and lower connector block 84 of the clamp shown in FIG. 7.

As is evident from the above description, the clamp and hoisting device of the present invention can be utilized in conjunction with a wide variety of tubulars and cylindrical structures. Also the links can be assembled in a variety of configurations.

Figure 18:
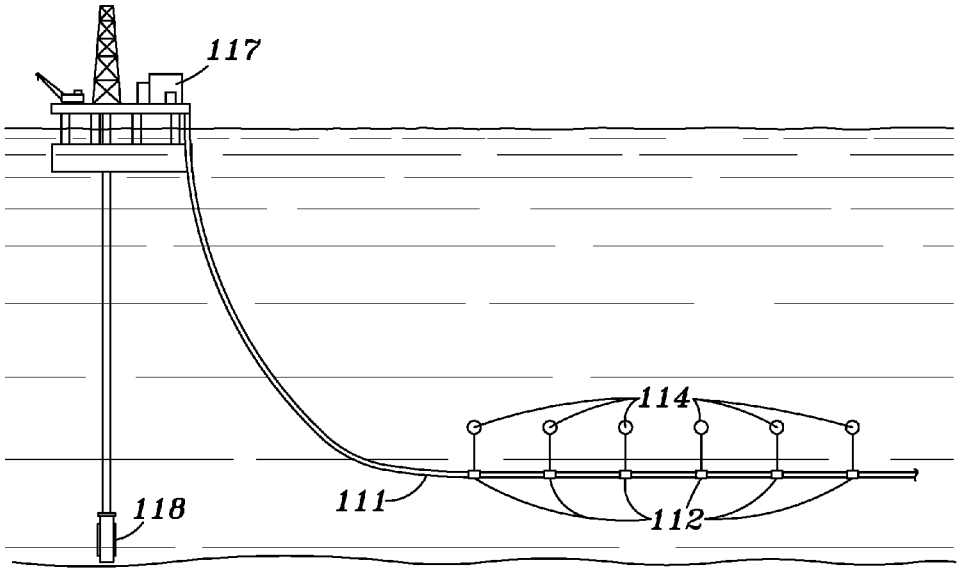
FIG. 18 is a schematic view showing the clamp used as a suspension device for a submerged tubular string.

For example, as shown in FIG. 18, the clamps 112 of the present invention could be utilized to support a tubular string 111 above the ocean floor 113 by suitable buoyancy devices 114. Tubular string 111 may be utilized to convey production oil from a floating platform 117 connected to an undersea wellhead 118.

Although the present invention has been described with respect to specific details, it is not intended that such details should be regarded as limitations on the scope of the invention, except to the extent that they are included in the accompanying claims.

I claim:

1. A clamp and hoisting device comprising:

an upper connector block, a first lower connector block, a first clamping arm formed by a plurality of links pivotably connected to each other, one of said links being pivoted connected to the upper connector block and a second one of said links being pivotably connected to the lower connector block, a second clamping arm formed by a second plurality of links pivotably connected to each other, one of said second plurality of links being pivotably connected to the upper connector block and a second one of said second plurality of links being pivotably connected to a second lower connector block, said links having a curved inner surface having a constant radius of curvature so that the surface conforms to an outer cylindrical surface of an object to be clamped.

2. A clamp and hoisting device as claimed in claim 1 wherein the inner surface of the links of each clamping arm form a segment of a circle.

3. A clamp and hoisting device as claimed in claim 1 wherein the first lower connector block has an arcuate inner surface which together with the inner surfaces of the links form a circle.

4. A clamping and hoisting device comprising:

a first clamping arm including a plurality of radially spaced arcuate links pivotably connected together, a second clamping arm including a second plurality of radially spaced arcuate links pivotably connected together, an upper connector block to which the first and second clamping arms are pivotably attached, a first lower connector block connected to a lower portion of the first clamping arm; and a second lower connector block connected to a lower portion of the second clamping arm, said links having a curved inner surface having a constant radius of curvature.

5. A clamping and hoisting device as claimed in claim 4 including a fastener to secure the first and second lower connector blocks together.

6. A clamp and hoisting device as claimed in claim 5 further including a block having an aperture for receiving a hoisting mechanism positioned between the first and second lower connector blocks.

7. A clamping and hoisting device as claimed in claim 4 wherein the first and second clamping arms further comprise a plurality of axially spaced arcuate links pivotably mounted together for rotation about a common axis.

8. A clamping and hoisting device as claimed in claim 4 wherein each clamping arm comprises a first flight of axially spaced links pivotably connected together about a common axis and a second flight of axially spaced links pivotably connected at an upper portion of the links of the second flight to a lower portion of the links in the first flight.

9. A clamp and hoisting device as claimed in claim 4 wherein the upper connector block includes an aperture for connection to a hoisting mechanism.

10. A clamp and hoisting device as claimed in claim 4 wherein the upper connector block includes a threaded bore for receiving a threaded eye bolt.

11. A clamp and hoisting device as claimed in claim 4 wherein the upper connector block includes a front and a back sidewall, and a plurality of partitions forming slots to receive the arcuate links; and a pivot pin passing through the front and back sidewalls and the partitions to pivotably mount a plurality of links about a common axis.

12. A clamp and hoisting device as claimed in claim 11 further including a second pivot pin extending through the front and back sidewalls and the partitions of the upper connector block to pivotably mount a plurality of links about a second common axis.

13. A clamping and hoisting device comprising:

a first clamping arm including a plurality of radially spaced arcuate links pivotably connected together, a second clamping arm including a second plurality of radially spaced arcuate links pivotably connected together, an upper connector block to which the first and second clamping arms are pivotably attached, a first lower connector block connected to a lower portion of the first clamping arm, a second lower connector block connected to a lower portion of the second clamping arm, wherein the upper connector block includes a front and a back sidewall, and a plurality of partitions forming slots to receive the arcuate links; and a pivot pin passing through the front and back sidewalls and the partitions to pivotably mount a plurality of links about a common axis.

14. A clamp and hoisting device as claimed in claim 13 further including a second pivot pin extending through the front and back sidewalls and the partitions of the upper connector block to pivotably mount a plurality of links about a second common axis.

* * * * *